US009032773B2

(12) United States Patent
Okumura et al.

(10) Patent No.: US 9,032,773 B2
(45) Date of Patent: May 19, 2015

(54) MANUFACTURING APPARATUS OF PLATE-LIKE TOOTH PROFILE MEMBER

(75) Inventors: Tadashi Okumura, Konan (JP); Nobuyasu Nishihata, Konan (JP); Kenji Tasaki, Konan (JP)

(73) Assignee: Gohsyu Corporation, Shiga (JP)

( * ) Notice: Subject to any disclaimer, the term of this patent is extended or adjusted under 35 U.S.C. 154(b) by 257 days.

(21) Appl. No.: 13/509,846

(22) PCT Filed: Nov. 19, 2010

(86) PCT No.: PCT/JP2010/070658

§ 371 (c)(1),
(2), (4) Date: Jun. 18, 2012

(87) PCT Pub. No.: WO2011/065297

PCT Pub. Date: Jun. 3, 2011

(65) Prior Publication Data

US 2012/0247172 A1 Oct. 4, 2012

(30) Foreign Application Priority Data

Nov. 26, 2009 (JP) ..... 2009-268542

(51) Int. Cl.
*B21K 1/76* (2006.01)
*B21J 13/02* (2006.01)
*B21J 5/12* (2006.01)

(52) U.S. Cl.
CPC ..... *B21K 1/767* (2013.01); *B21J 13/025* (2013.01); *B21J 5/12* (2013.01)

(58) Field of Classification Search
CPC ..... B21J 5/12; B21J 13/025; B21K 1/767; B21K 1/30
USPC ..... 72/353.2, 353.6, 355.2, 355.6, 469
See application file for complete search history.

(56) References Cited

U.S. PATENT DOCUMENTS

| | | | | |
|---|---|---|---|---|
| 4,571,982 | A * | 2/1986 | Bishop et al. | 72/400 |
| 5,862,701 | A | 1/1999 | Bishop et al. | |
| 2004/0182125 | A1 | 9/2004 | McLean | |
| 2007/0079643 | A1 * | 4/2007 | Dohmann et al. | 72/353.2 |

FOREIGN PATENT DOCUMENTS

| | | |
|---|---|---|
| JP | 9-506550 | 6/1997 |
| JP | 2000-153336 | 6/2000 |
| JP | 2004-523365 | 8/2004 |

OTHER PUBLICATIONS

International Search Report issued Dec. 21, 2010 in International (PCT) Application No. PCT/JP2010/070658.

* cited by examiner

*Primary Examiner* — Debra Sullivan
(74) *Attorney, Agent, or Firm* — Wenderoth, Lind & Ponack, L.L.P.

(57) ABSTRACT

[Problem] To present a manufacturing apparatus of a plate-like tooth profile member capable of forging and forming in one process by using a closed type die, being hardly accompanied by burrs due to plastic changes in the circumferential direction and in the axial direction of the material of the plate-like tooth profile member.

[Solving Means] Consisting of an upper die 1 and a lower die 2 of closed type, the lower die 2 is composed of a tooth die 21 for forming a tooth portion in a material W of a plate-like tooth profile member, and movable dies 22, 22 movable relatively in a vertical direction to the tooth die 21 disposed at both sides in the axial direction of the material W of the plate-like tooth profile member of the tooth die 21, a first stroke is executed for confining the circumference at both end portions in the axial direction of the material W of the plate-like tooth profile member by the upper die 1 and the movable dies 22, 22, and a second stroke is executed for forming a tooth portion in the material W of the plate-like tooth profile member by the upper die 1 and the tooth die 21.

1 Claim, 4 Drawing Sheets

MANUFACTURING APPARATUS OF PLATE-LIKE TOOTH PROFILE MEMBER

TECHNICAL FIELD

The present invention relates to a manufacturing apparatus of a plate-like tooth profile member, and more particularly to a manufacturing apparatus of a plate-like tooth profile member consisting of an upper die and a lower die of closed type.

BACKGROUND ART

Conventionally, a manufacturing method and its apparatus of a steering rack (for example, a variable steering rack of a complicated shape) for forging and forming in one process by using a closed type die, and minimizing the deburring work of a product after the forming process have been proposed by the present applicants and put in practical use (see, for example, patent document 1).

The manufacturing apparatus of the steering rack disclosed in patent document 1 is designed to forge and form by using a closed type die formed to absorb an escape of materials due to plastic deformation, depending on the shape of the steering rack to be formed, and since the forging and forming operation is carried out in one process, plastic changes in the circumferential direction hardly appear as burrs, and the deburring process of the product after forging and forming can be saved, and the manufacturing cost can be lowered.

However, in this manufacturing apparatus of the steering rack, since the upper die and the lower die are individually made of a die of integral shape, from the beginning of the process of forming a tooth portion in the steering rack material, it is not possible to confine the circumference at both end portions in the axial direction of the steering rack material by the upper die and the lower die, and the wall of a tooth portion forming part of the steering rack material escapes to the end portion side in the axial direction of the steering rack material, and burrs may be formed at this position, and the wall thickness of the tooth portion forming part may be insufficient, and the yield is lowered when manufacturing products, and the forming precision of the products becomes inferior.

PRIOR ART LITERATURE

Patent document

Patent document 1: Japanese Patent Application Laid-Open No. 2000-153336

SUMMARY OF THE INVENTION

Problems to be Solved by the Invention

The invention is devised in the light of the problems of the conventional manufacturing apparatus of the steering rack, and it is a primary object thereof to present a manufacturing apparatus of a plate-like tooth profile member capable of forging and forming in one process by using a closed type die, minimizing occurrence of burrs due to plastic changes in the circumferential direction and in the axial direction of the material of the plate-like tooth profile member, and enhancing the yield when manufacturing products, and enhancing the forming precision of the products.

Means for Solving the Problems

To achieve the object, the manufacturing apparatus of the plate-like tooth profile member of the invention is a manufacturing apparatus of a plate-like tooth profile member consisting of an upper die and a lower die of closed type, in which one die of the upper die and the lower die is composed of a tooth die for forming a tooth portion in a material of the plate-like tooth profile member, and a movable die movable relatively in a vertical direction to the tooth die disposed at both sides in the axial direction of the material of the plate-like tooth profile member of the tooth die, comprising a first stroke of confining the circumference at both end portions in the axial direction of the material of the plate-like tooth profile member by other die of the upper die and the lower die and the movable die, and a second stroke of forming a tooth portion in the material of the plate-like tooth profile member by the other die of the upper die and the lower die and the tooth die.

In this case, the tooth die is composed of a tooth surface forming die for forming a tooth surface in the material of the plate-like tooth profile member, divided in a direction orthogonal to the axial direction of the material of the plate-like tooth profile member, and a tooth lateral surface forming die for forming a tooth lateral surface of the material of the plate-like tooth profile member, disposed at both sides.

The tooth lateral surface forming die may be composed of a base body, and a tooth lateral surface forming piece for forming the tooth lateral surface of the material of the plate-like tooth profile member disposed detachably in the base body, in which other die of the upper die and the lower die, and the tooth lateral surface forming piece contact flatly with each other in a plane.

Effects of the Invention

According to the manufacturing apparatus of the plate-like tooth profile member of the invention, by executing a first stroke of confining the circumference at both end portions in the axial direction of the material of the plate-like tooth profile member by other die of the upper die and the lower die and the movable die, and a second stroke of forming a tooth portion in the material of the plate-like tooth profile member by the other die of the upper die and the lower die and the tooth die, from the beginning of the process of forming the tooth portion in the material of the plate-like tooth profile member, it is possible to confine the circumference at both end portions in the axial direction of the material of the plate-like tooth profile member by the upper die and the lower die, thereby preventing the wall of the tooth portion forming part of the material of the plate-like tooth profile member from escaping to the end portion side in the axial direction of the material of the plate-like tooth profile member.

As a result, burrs may be hardly formed by plastic changes in the circumferential direction and in the axial direction of the material of the plate-like tooth profile member, and the wall thickness may not be insufficient in the tooth forming portion of the material of the plate-like tooth profile member, so that the product manufacturing yield and the product forming precision may be enhanced.

Moreover, a tooth portion can be formed form a material of the plate-like tooth profile member of a small diameter, and the product may be reduced in weight.

The tooth die is composed of a tooth surface forming die for forming a tooth surface in the material of the plate-like tooth profile member, divided in a direction orthogonal to the axial direction of the material of the plate-like tooth profile member, and a tooth lateral surface forming die for forming a tooth lateral surface of the material of the plate-like tooth profile member, disposed at both sides, and therefore in the case of a complicated shape such as a variable steering rack, for example, in the case of a plate-like tooth profile member differing in the plastic deformation amount of the material at each position, an excess potion of the material due to plastic deformation by the tooth lateral surface forming die can be securely absorbed, and the product manufacturing yield and the product forming precision may be enhanced.

The tooth lateral surface forming die may be composed of a base body, and a tooth lateral surface forming piece for forming the tooth lateral surface of the material of the plate-like tooth profile member disposed detachably in the base body, and by properly designing the tooth lateral surface forming piece of the tooth lateral surface forming die, an excess potion of the material due to plastic deformation may be more securely absorbed, and the product manufacturing yield and the product forming precision may be further enhanced.

PREFERRED EMBODIMENT OF THE INVENTION

A preferred embodiment of a manufacturing apparatus of a plate-like tooth profile member of the invention is described according to the drawings.

Figure 1:
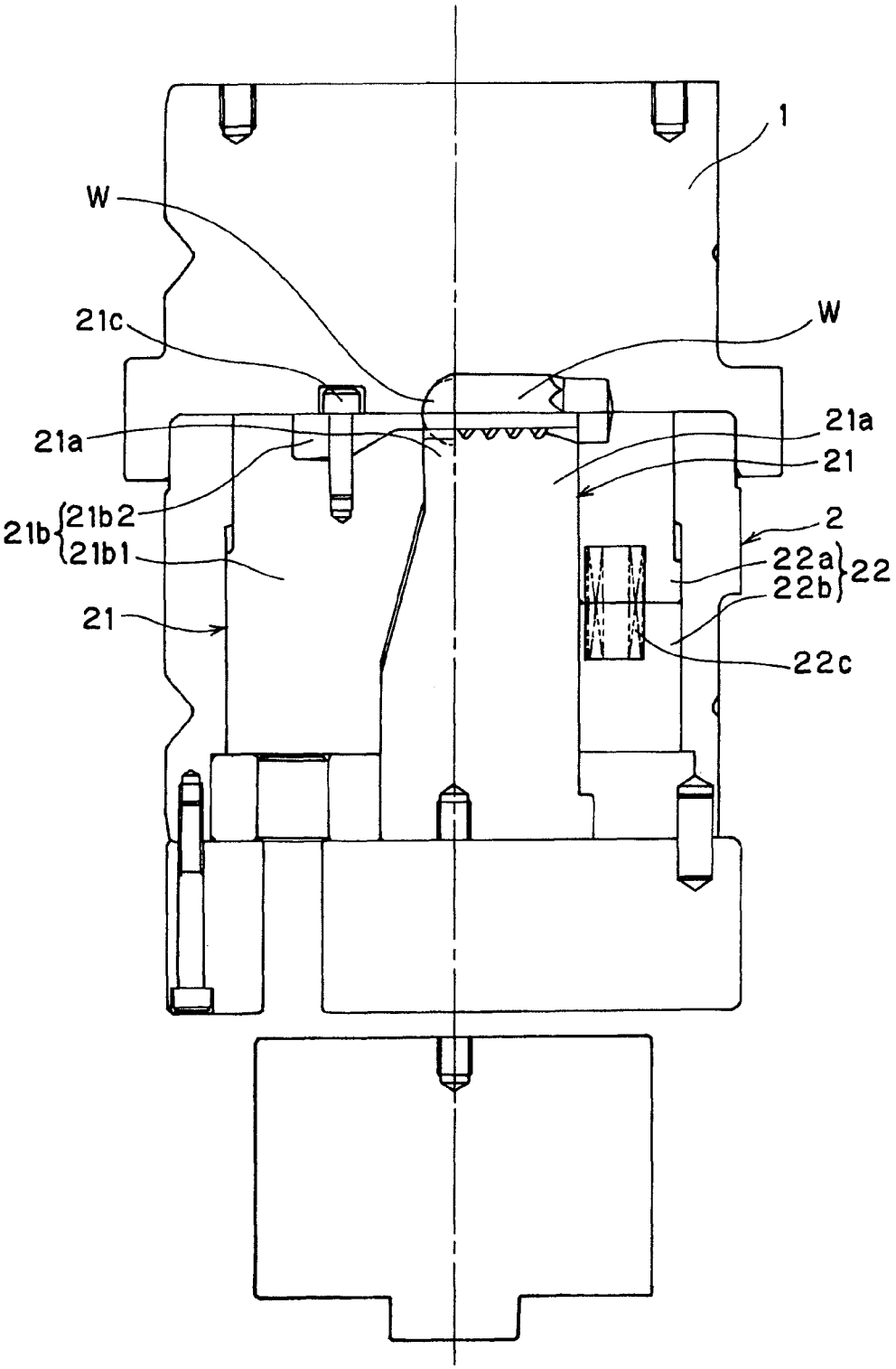
FIG. 1 is an explanatory diagram showing a preferred embodiment of a manufacturing apparatus of a plate-like tooth profile member of the invention, the right-half drawing being a sectional view along an axial direction of a steering rack material, and the left-half drawing being a sectional view along a direction orthogonal to the axial direction of the steering rack material.
Figure 2:
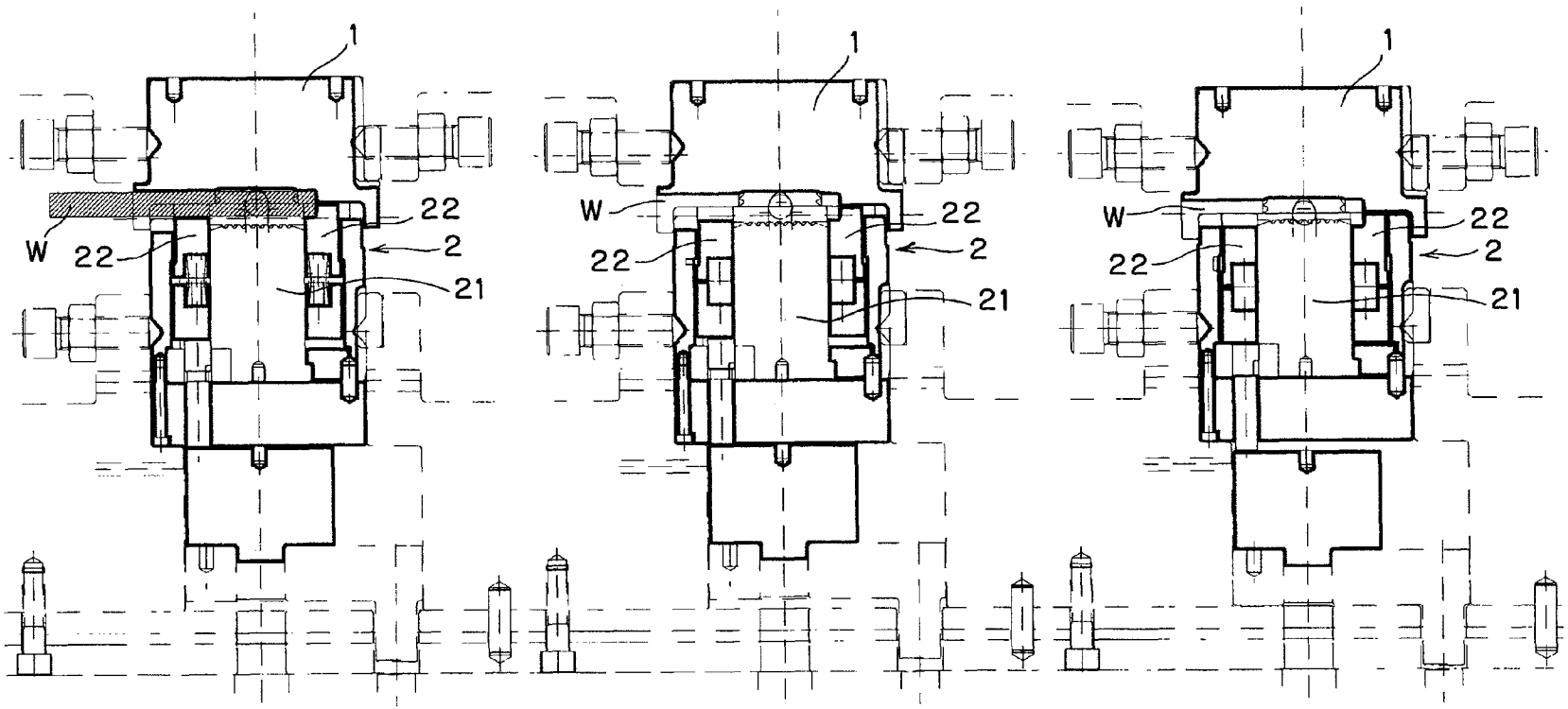
FIG. 2 is an explanatory diagram of a forging and forming process by the manufacturing apparatus.

FIG. 1 and FIG. 2 show a preferred embodiment of a manufacturing apparatus of a plate-like tooth profile member of the invention.

This manufacturing apparatus of the plate-like tooth profile member is designed to manufacture a steering rack as a plate-like tooth profile member, consisting of an upper die 1 and a lower die 2 of closed type, in which one die of the upper die 1 and the lower die 2, that is, the lower die 2 in the preferred embodiment is composed of a tooth die 21 for forming a tooth portion in a steering rack material W, and movable dies 22, 22 movable relatively in a vertical direction to the tooth die 21 disposed at both sides in an axial direction of the steering rack material W of this tooth die 21, and executes a first stroke of confining the circumference at both end portions in the axial direction of the steering rack material W by other die of the upper die 1 and the lower die 2, or by the upper die 1, in the preferred embodiment, and the movable dies 22, 22, and a second stroke of forming a tooth portion in the steering rack material W by the other die of the upper die 1 and the lower die 2, or by the upper die 1, in the preferred embodiment, and the tooth die 21.

In this case, the tooth die 21 is composed of a tooth surface forming die 21*a* for forming a tooth surface in the steering rack material W, divided in a direction orthogonal to the axial direction of the steering rack material W, and a tooth lateral surface forming die 21*b* for forming a tooth lateral surface of the steering rack material W, disposed at both sides, and the tooth lateral surface forming die 21*b* may be composed of a base body 21*b*1, and a tooth lateral surface forming piece 21*b*2 for forming the tooth lateral surface of the steering rack material W disposed detachably in the base body 21*b*1 by a screw member 21*c*.

Herein, the tooth lateral surface forming piece 21*b*2 is to define the tooth lateral surface of the steering rack material W, and by properly designing the shape, an excess wall of the material due to plastic deformation can be securely absorbed, and the product manufacturing yield and the product forming precision can be enhanced, and as in this preferred embodiment, by disposing the tooth lateral surface forming piece 21*b*2 detachably in the base body 21*b*1 by the screw member 21*c*, the shape of the tooth lateral surface forming piece 21*b*2 can be changed easily.

The movable die 22 is composed of an upper movable die 22*a* and a lower movable die 22*b* divided in a vertical direction, and thrusting means such as spring 22*c* or the like is inserted between them, and the upper movable die 22*a* is provided with an annular material accommodating portion for confining each end portion of the steering rack material W in the axial direction.

In the preferred embodiment, one end side of the material accommodating portion formed in the upper movable die 22*a* and the lower movable die 22*b* forms a space closed in a state of contacting between the upper movable die 22*a* and the lower movable die 22*b*, and a draft angle is formed at the side face of one end side of the material accommodating portion, while other end side is opened in a state of contacting between the upper movable die 22*a* and the lower movable die 22*b*, so that one end side of the steering rack material W may be led out, but the material accommodating portion may be formed appropriately depending on the steering rack material W (the steering rack to be manufactured).

Also in the preferred embodiment, the upper die 1, different from the lower die 2, is composed of an integral material, forming about a half of the outer circumference of the tooth portion of the steering rack material W, and is provided with an annular material accommodating portion so as to confine each end portion in the axial direction, but the structure of the upper die 1 and the lower die 2 may be turned upside down.

The following is an explanation of a manufacturing process of the steering rack by using this manufacturing apparatus of the plate-like tooth profile member.

In the first place, a material suited to manufacturing of a steering rack, for example, a round steel bar of medium carbon steel or the like is cut to a prescribed length, and this cut piece of the steering rack material W is processed by polishing, roughening or the like.

The roughened steering rack material W is heated to an appropriate forging temperature, for example, 750° C. to 900° C. in the case of warm forging (this temperature varies with the material quality of the steering rack material W). In this heating process, a heating oven may be used, or it may be realized also by induction heating or electric heating, and a desired heating temperature may be reached in a short time, and occurrence of oxide scale or decarbonization may be prevented, and each position may be heated accurately depending on the shape of the steering rack to be controlled in temperature.

Consequently, the steering rack material W reaching a desired forging temperature is forged and formed by the manufacturing apparatus of the plate-like tooth profile member consisting of the upper die 1 and the lower die 2 of closed type.

In this case, in a first stroke of forging and forming, by confining the circumference at both end portions in the axial direction of the steering rack material W by the upper die 1 and the movable dies 22, 22 of the lower die 2 (FIG. 2(*a*)), this state is maintained, and in a second stroke, a tooth portion is formed in the steering rack material W by the upper die 1 and the tooth die 21 of the lower die 2 (FIG. 2(*b*), (*c*)).

By this manufacturing apparatus of the plate-like tooth profile member, from the beginning of the process of forming a tooth portion in the steering rack material W, it is possible to confine the circumference at both end portions in the axial direction of the steering rack material W by the upper die 1 and the lower die 2, and the wall of a tooth portion forming part of the steering rack material W is prevented from escaping to the end portion side in the axial direction of the steering rack material W.

As a result, burrs are hardly formed due to plastic changes in the circumferential direction and the axial direction of the steering rack material W, and the wall thickness of the tooth portion forming part of the steering rack material W may not be insufficient, and the product manufacturing yield and the product forming precision may be enhanced.

Moreover, the tooth portion may be formed from the steering rack material W of a small diameter, and the product weight may be reduced.

In this case, by appropriately designing the tooth lateral surface forming piece 21*b*2 disposed detachably in the base body 21*b*1 of the tooth lateral surface forming die 21*b* of the tooth die 21 by means of the screw member 21*c*, by adjusting finely, the excess material portion due to plastic changes can be securely absorbed, and the product manufacturing yield and the product forming precision may be enhanced.

Thus, after the roughening process, by forging and forming the steering rack material W heated to a proper forging temperature by the manufacturing apparatus of the plate-like tooth profile member consisting of the upper die 1 and the lower die 2 of closed type, a steering rack P of high forming precision can be manufactured in one process.

Figure 3:
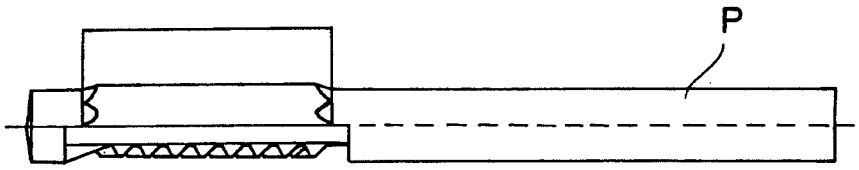
FIG. 3 is an explanatory diagram of a manufactured steering rack.
Figure 3:
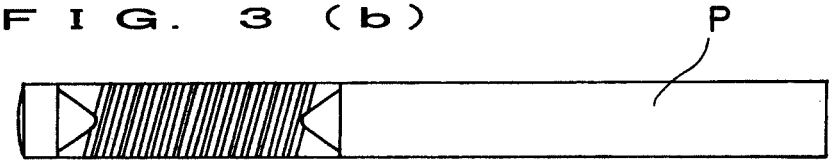
Figure 4:
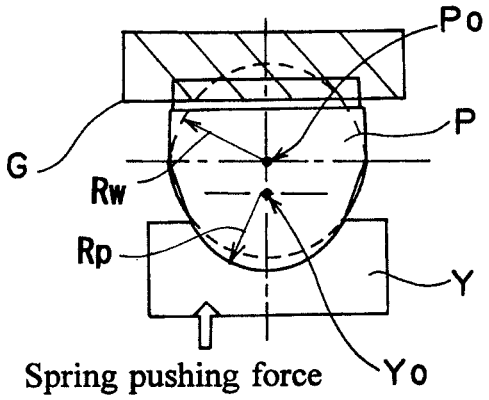
FIG. 4 is an explanatory diagram of the manufactured steering rack.
Figure 4:
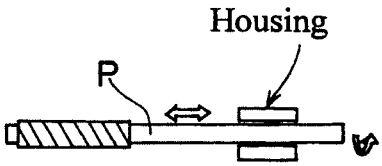

The steering rack P is manufactured in this manner, and as shown in FIG. 3 and FIG. 4, by forming the steering rack P so that its radius Rp being supported by a yoke Y (the radius of the support surface of the yoke Y supporting the steering rack P) may be smaller than the radius Rw of the steering rack material W, a center Po of the steering rack P and a center Yo of the yoke Y are deviated, and therefore when a pinion gear G and the steering rack P are engaged with each other, if the steering rack P is to move in the rotating direction, since it is pressed by the yoke Y deviated in the center, the steering rack P is prevented from oscillating.

Figure 5:
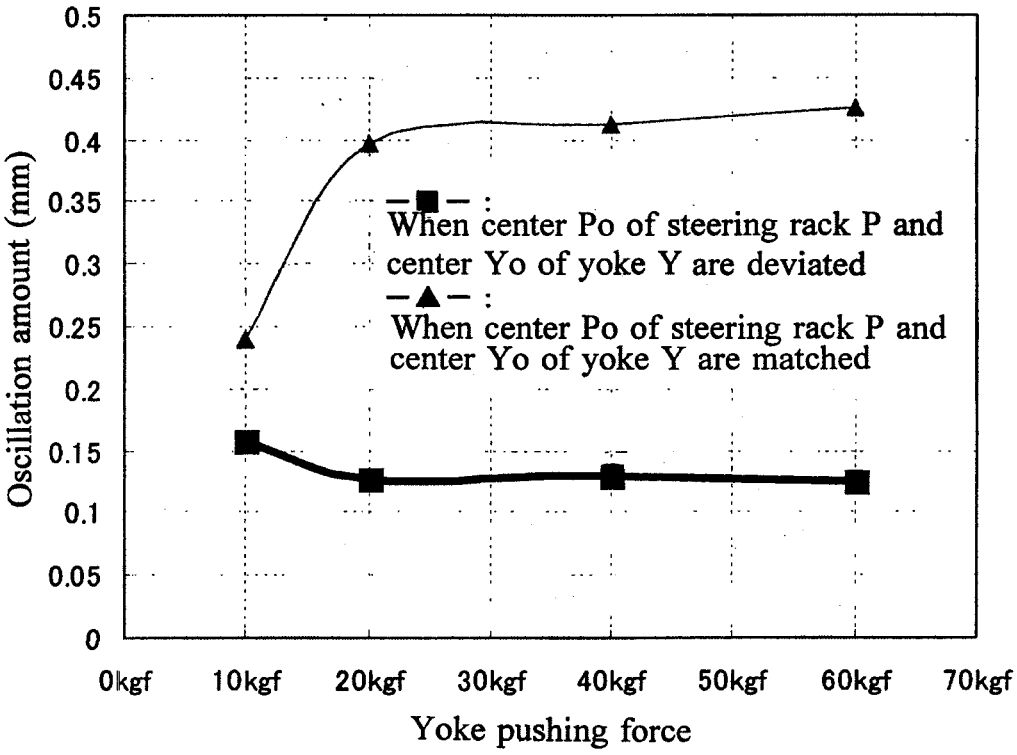
FIG. 5 is an explanatory diagram showing an oscillation amount in the case of a coincidence by deviating between the center of a steering rack and the center of a yoke.

FIG. 5 shows an oscillation amount in the case of a coincidence by deviating between the center Po of the steering rack P and the center Yo of the yoke Y.

As shown in FIG. 5, by deviating the center Po of the steering rack P and the center Yo of the yoke Y, as compared with the case of coincidence of the two, the oscillation amount of the steering rack P can be decreased, and the engagement state of the steering rack P can be stabilized.

Herein, the manufacturing apparatus of the plate-like tooth profile member of the invention is described by referring to a preferred embodiment of an apparatus for manufacturing a steering rack, but the invention is not limited to the illustrated preferred embodiment alone, but may be changed and modified in various configurations in a range not departing from the true spirit of the invention, and the object of manufacturing is not limited to the steering rack alone, but may include any other apparatus for manufacturing various plate-like tooth profile members.

INDUSTRIAL APPLICABILITY

The manufacturing apparatus of the plate-like tooth profile member of the invention is capable of forging and forming in one process by using a closed type die, being hardly accompanied by burrs due to plastic changes in the circumferential direction and in the axial direction of the material of the plate-like tooth profile member, and is enhanced in the product manufacturing yield and the product forming precision, and is hence applicable in manufacturing of variable steering racks of complicated shapes, other steering racks, and other plate-like tooth profile members.

DESCRIPTION OF THE REFERENCE NUMERALS

1 Upper Die
2 Lower Die
21 Tooth Die
21*a* Tooth Surface Forming Die
21*b* Tooth Lateral Surface Forming Die
21*b*1 Base Body
21*b*2 Tooth Lateral Surface Forming Piece
21*c* Screw Member
22 Movable Die
22*a* Upper Movable Die
22*b* Lower Movable Die
22*c* Spring
P Steering Rack (plate-like tooth profile member)
W Steering Rack Material (material of plate-like tooth profile member)

The invention claimed is:

1. A manufacturing apparatus of a plate tooth profile member, comprising an upper die and a lower die of closed type, wherein the lower die comprises a tooth die for forming a tooth portion in a material of the plate tooth profile member, and a movable die movable relatively in a vertical direction to the tooth die, the movable die being disposed at both sides of the tooth die in an axial direction of the material, for executing a first stroke of confining the circumference of the material at both end portions of the material in the axial direction of the material by the movable die and the upper die, and a second stroke of forming the tooth portion in the material by the tooth die and the upper die, wherein the tooth die comprises a tooth surface forming die for forming the tooth portion in the material, the tooth surface forming die being divided in a direction orthogonal to the axial direction of the material, and a tooth lateral surface forming die for forming a tooth lateral surface in the material, wherein the tooth lateral surface forming die comprises a base body, and a tooth lateral surface forming piece for forming the tooth lateral surface in the material, the tooth lateral surface forming piece being disposed detachably in the base body, wherein the upper die and the tooth lateral surface forming piece of the lower die contact flatly with each other in a plane and wherein the upper die, different from the lower die, comprises an integral material forming about half of an outer circumference of the tooth portion of the material, and is provided with an annular material accommodating portion so as to confine each end portion of the material in the axial direction.

* * * * *